US010312607B2

(12) United States Patent
Wilson et al.

(10) Patent No.: US 10,312,607 B2
(45) Date of Patent: Jun. 4, 2019

(54) POLARITY-INVERTING TELECOMMUNICATION TAP

(71) Applicant: PCT International, Inc., Mesa, AZ (US)

(72) Inventors: Brandon Wilson, Phoenix, AZ (US); Kang Lin, Chandler, AZ (US)

(73) Assignee: PCT International, Inc., Mesa ( * ) Notice: Subject to any disclaimer, the term of this patent is extended or adjusted under 35 U.S.C. 154(b) by 0 days.

(21) Appl. No.: 16/148,919

(22) Filed: Oct. 1, 2018

(65) Prior Publication Data

US 2019/0103686 A1 Apr. 4, 2019

Related U.S. Application Data

(60) Provisional application No. 62/566,837, filed on Oct. 2, 2017.

(51) Int. Cl.

| | |
|---|---|
| ***H01R 12/00*** | (2006.01) |
| ***H01R 12/51*** | (2011.01) |
| ***H01R 12/71*** | (2011.01) |
| ***H01R 31/06*** | (2006.01) |
| ***H01R 13/512*** | (2006.01) |

(52) U.S. Cl.

CPC ..... *H01R 12/515* (2013.01); *H01R 12/718* (2013.01); *H01R 13/512* (2013.01); *H01R 31/06* (2013.01)

(58) Field of Classification Search

CPC .... H01R 12/515; H01R 12/51; H01R 12/718; H01R 13/512; H01R 31/06; H01R 31/065

USPC ..... 439/76.1, 78, 579

See application file for complete search history.

(56) References Cited

U.S. PATENT DOCUMENTS

| | | | | |
|---|---|---|---|---|
| 5,677,578 | A * | 10/1997 | Tang | H01R 9/0509 307/119 |
| 5,756,935 | A | 5/1998 | Balanovsky et al. | |
| 6,292,371 | B1 | 9/2001 | Toner, Jr. | |
| 9,923,319 | B2 | 3/2018 | Ariesen et al. | |
| 2004/0189806 | A1 | 9/2004 | Berkey | |
| 2005/0078918 | A1 | 4/2005 | Wang | |
| 2015/0067755 | A1 | 3/2015 | Conroy et al. | |
| 2018/0254538 | A1 | 9/2018 | Palawinna et al. | |

* cited by examiner

*Primary Examiner* — Khiem M Nguyen

(74) *Attorney, Agent, or Firm* — Thomas W. Galvani, P.C.; Thomas W. Galvani

(57) ABSTRACT

A polarity-inverting telecommunication tap includes a backplate having an input port, an output port, and terminal posts. The input and output ports communicate a signal having a signal polarity. The tap also includes a faceplate having a tap port and having sockets corresponding and complemental to the terminal posts. The tap port communicates a tap signal having a tap signal polarity. The tap further includes an adapter plate disposed between the backplate and faceplate. The adapter plate has an electrical circuit which inverts the tap signal polarity with respect to the signal polarity, so that downstream CATV devices may operate with an intended polarity.

17 Claims, 3 Drawing Sheets

POLARITY-INVERTING TELECOMMUNICATION TAP

CROSS-REFERENCE TO RELATED APPLICATIONS

This application claims the benefit of U.S. Provisional Application No. 62/566,837, filed Oct. 2, 2017, all of which are hereby incorporated by reference.

FIELD OF THE INVENTION

The present invention relates generally to telecommunication, and more particularly to passive CATV devices.

BACKGROUND OF THE INVENTION

Radio frequency ("RF") communications, such as cable TV ("CATV") and internet services, are delivered to subscribers through lines and cables. Major cable operators have hybrid fiber coaxial ("HFC") architecture in which a fiber optic line runs from an upstream source, such as the plant or headend, to a downstream local node. At the node, the fiber optic line is coupled to coaxial cables which eventually connect individual subscribers to RF services.

The provision of such RF services is inherently limited by the physical hardware the cable operator installs and controls. Cable operators attempt to forecast technology improvements, population growth, and telecommunication needs as they install these lines and cables. However, this task is difficult and not always accurate.

In some regions, nodes are unevenly distributed with respect to the population density. This can result in some subscribers receiving different service levels: a node serving only several dozen subscribers will generally deliver better performance to its subscribers than will a node serving a dense neighborhood of several hundred or more subscribers. Preferably, each node would serve the same number of subscribers, so that node distribution would be even and balanced. However, later node balancing by installing nodes in subscriber-dense areas is time- and labor-intensive and expensive, and most cable operators resist it.

To reduce the number of subscribers per node, some cable operators employ a technique called node splitting. Node splitting halves the subscriber density, thereby increasing the bandwidth for the node. When a node is split, one side of the split maintains its previous or original signal directionality or polarity. However, on the other side of the split, the directionality is reversed or inverted. Many CATV devices are preferably uni-directional, and this reversal can cause performance issues, especially in passive devices.

Flipping a device is sometimes one approach some operators use. However, simply physically flipping a device often is not a solution because of the dedicated footprint of the existing device; the footprints of many CATV devices are keyed and asymmetric, meaning they cannot simply be flipped or rotated. Taps, or directional couplers, are examples of such devices. Further, flipping a device is expensive, as it usually requires cuts and splices to be made. Various solutions have been proposed to address this problem. For instance, the CATV device can be completely replaced with one which accommodates the reversed direction. Alternatively, a portion of the existing device can be removed and replaced. These solutions, of course, require changing out the tap lies and may require changing the hard lines to the tap. This is expensive and breaks lines which are in known working order. An improved CATV device which accommodates and rectifies this signal polarity reversal is needed.

SUMMARY OF THE INVENTION

A polarity-inverting telecommunication tap includes a backplate having an input port, an output port, and terminal posts. The input and output ports communicate a signal having a signal polarity. The tap also includes a faceplate having a tap port and having sockets corresponding and complemental to the terminal posts. The tap port communicates a tap signal having a tap signal polarity. The tap further includes an adapter plate disposed between the backplate and faceplate. The adapter plate has an electrical circuit which inverts the tap signal polarity with respect to the signal polarity, so that downstream CATV devices may operate with an intended polarity.

The above provides the reader with a very brief summary of some embodiments discussed below. Simplifications and omissions are made, and the summary is not intended to limit or define in any way the scope of the invention or key aspects thereof. Rather, this brief summary merely introduces the reader to some aspects of the invention in preparation for the detailed description that follows.

BRIEF DESCRIPTION OF THE DRAWINGS

Referring to the drawings.

DETAILED DESCRIPTION

Figure 1:
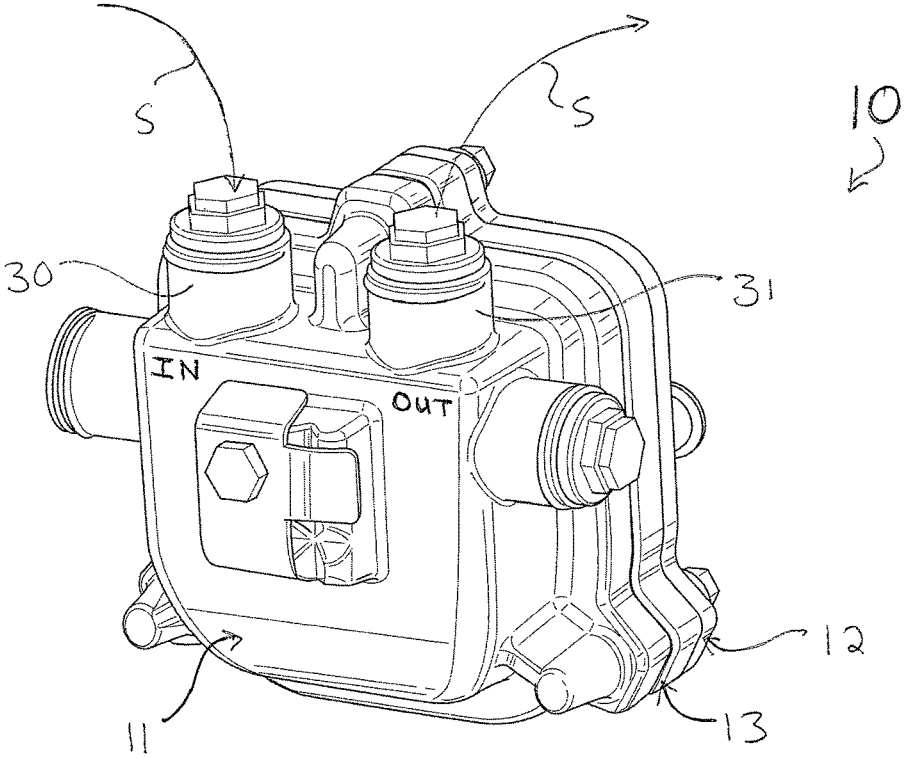
FIGS. 1 and 2 are rear and front perspective views of a polarity-inverting telecommunication tap.
Figure 2:
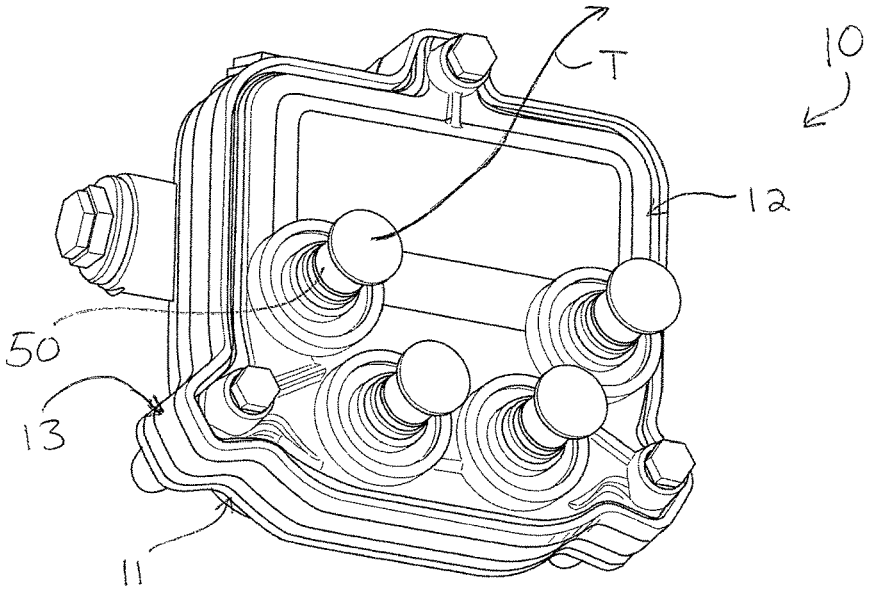

Reference now is made to the drawings, in which the same reference characters are used throughout the different figures to designate the same elements. FIGS. 1 and 2 illustrate a telecommunication tap 10. The tap 10 includes a backplate 11, an opposed faceplate 12, and an adapter plate 13 disposed therebetween. The adapter plate 13 is useful for inverting the polarity or directionality of a CATV signal S within the tap 10, so as to allows subscriber CATV devices connected to the tap 10 to function with correct polarity, despite the presence of a node split upstream from the tap 10.

Figure 3:
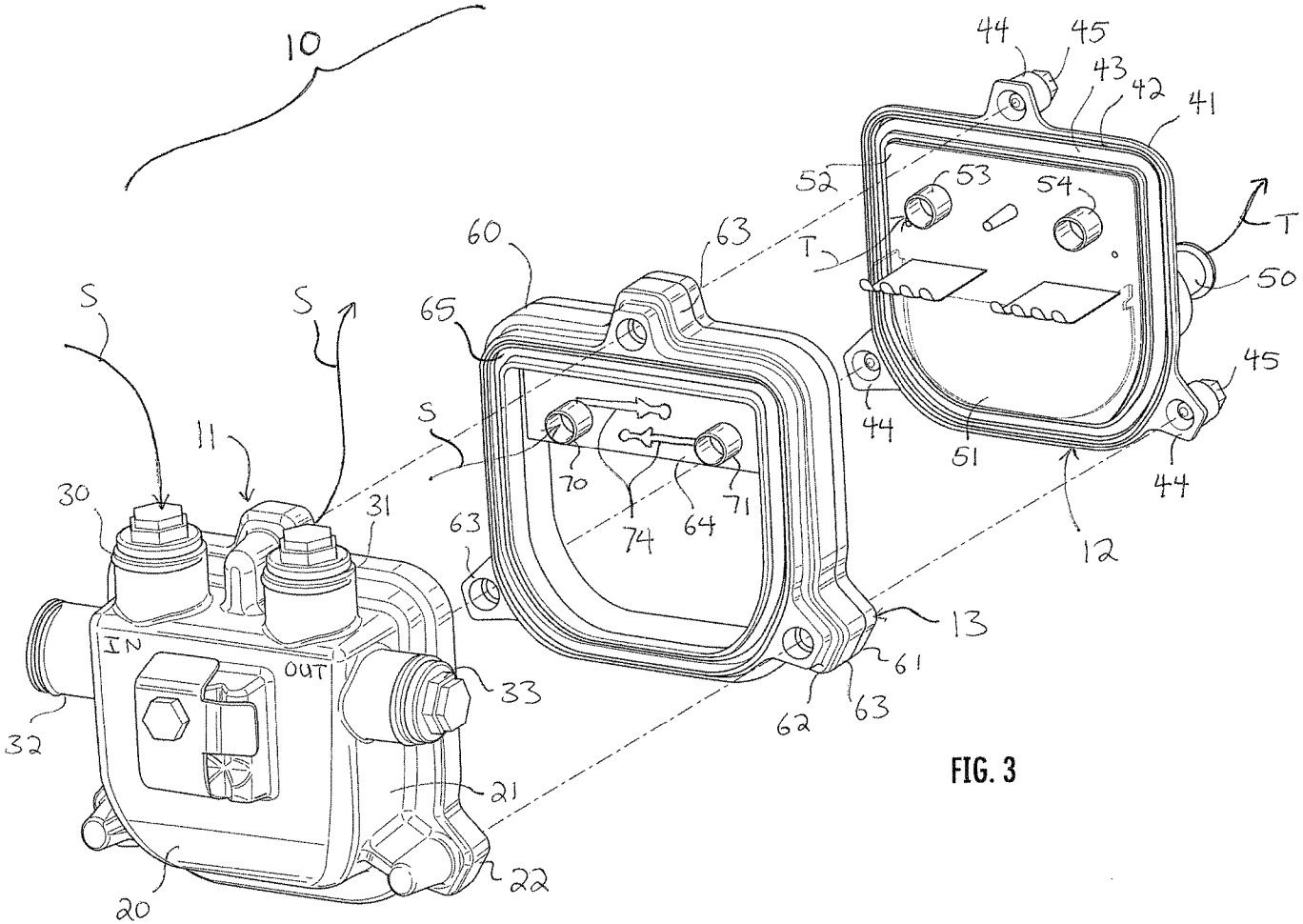
FIGS. 3 and 4 are exploded, rear and front perspective views of the tap of FIG. 1.
Figure 4:
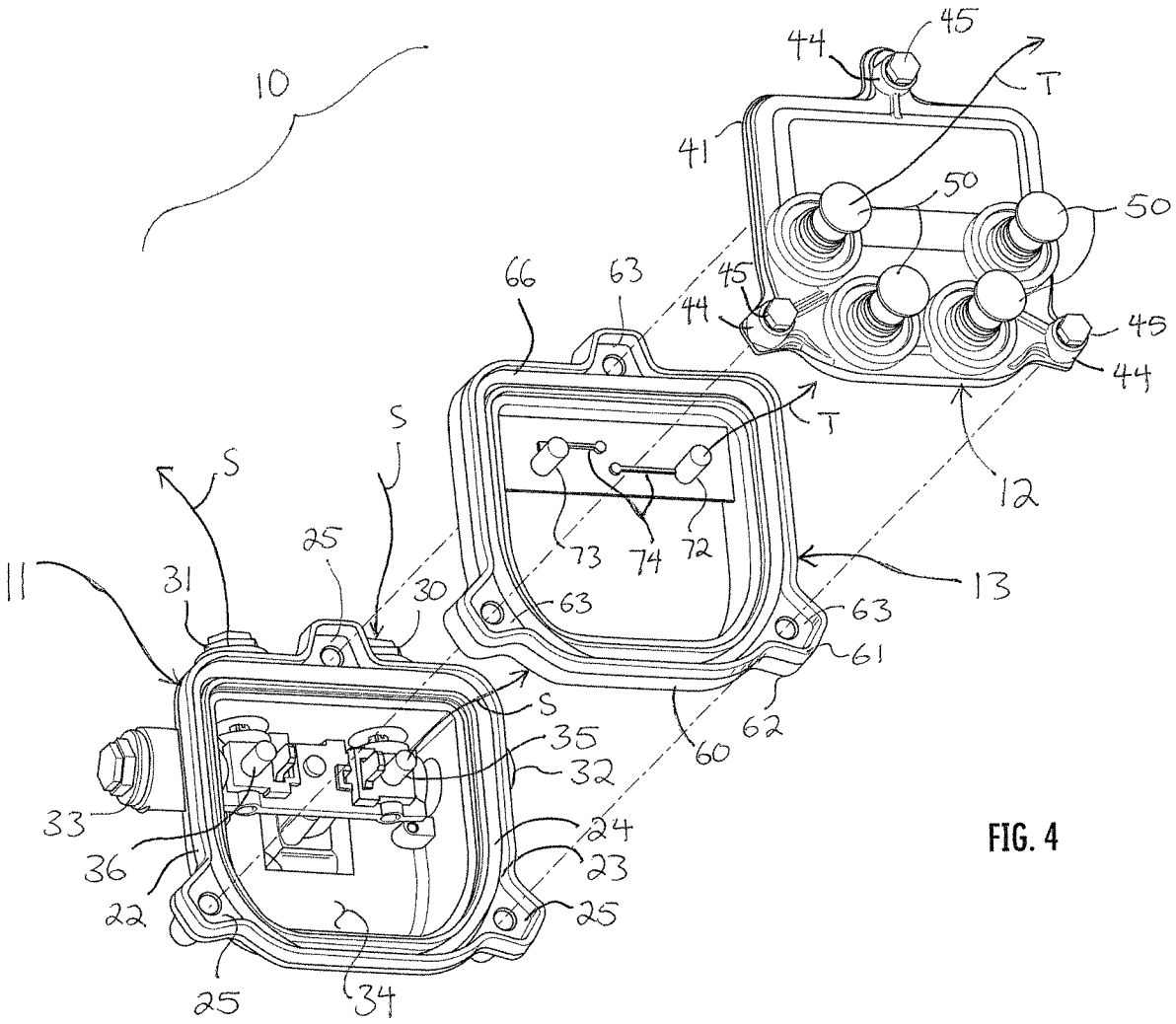

Referring primarily now to FIGS. 3 and 4, the backplate 11 has two sets of coaxial cable posts for connecting the tap 10 to a telecommunication line such as a feeder cable or hard line. The backplate 11 shown here has a well-known footprint or form factor with a flat top, flat sides, and a curved bottom. This is one of four primary form factors most prominent in the industry, though this invention is not limited to only this or any of the four primary four factors. A conventional form factor is illustrated here because cable operators are resistant to implementing new devices with new footprints, as there is great cost in installing them in the field.

The backplate 11 is a rigid frame, preferably made of metal or plastic, and includes a back 20 and an upstanding sidewall 21 extending forward from the back 20 and terminating at an enlarged peripheral lip 22. As seen in FIG. 4, the backplate 11 includes a peripheral channel 23 extending continuously around the lip 22. The channel 23 closely holds a rubber seal or other type of gasket 24. The channel 23 is configured to receive the gasket 24 usually carried by a faceplate, but in this embodiment, the channel 23 carries the gasket 24. The backplate 11 also includes three mounts 25 for fasteners such as bolts or screws, so that the faceplate 12 and adapter plate 13 can be attached to the backplate 11 securely.

Referring primarily to FIG. 3 now, the backplate 11 includes two sets of ports. A first set of ports 30 and 31 project up from the top of the backplate 11, and a second set of ports 32 and 33 project from opposed sides of the backplate 11. All four of the ports 30-33 are coaxial ports, such as for transmitting RF signals, but in other embodiments may have other forms for transmitting other types of signals. All four of the ports 30-33 are shown fit with caps in the drawings. The ports 30 and 31 are used when the tap 10 is installed within a ground-located pedestal housing, and the ports 32 and 33 are used when the tap 10 is suspended in an aerial installation on an elevated cable line, such as proximate telephone and power lines.

The ports 30 and 32 are "input" ports (when viewed from the perspective of the RF signal S transmitted downstream to the tap 10 from a node split), and the ports 31 and 33 are "output" ports. This description may thus refer to the ports 30 and 32 as merely ports 30 and 32 or as input ports 30 and 32, and likewise may refer to the ports 31 and 33 merely as ports 31 and 33 or as output ports 31 and 33. The labels "in" and "out" are applied to the outer surface of the back 20 so that a technician working on the tap 10 can quickly determine the configuration of the tap 10 and how to connect it in the field.

The ports 30-33 are structurally identical but located in different places on the backplate 11. As such, the description herein will refer only to the ports 30 and 31 with the understanding that the description applies equally to the ports 32 and 33. The ports 30 and 31 extend into an interior 34 of the backplate 11, where they are electrically coupled to terminal posts 35 and 36, respectively. The ports 32 and 33 are also electrically coupled to the terminal posts 35 and 36, respectively. The posts 35 and 36 are short, straight cylindrical projections extending forwardly toward the faceplate 12 and are constructed from a material or combination of materials having good electrical conductivity. When the faceplate 12 is directly attached to the backplate 11, the posts 35 and 36 are seated into corresponding sockets on the faceplate 12, establishing an electrical connection so that the signal S can be transmitted between the backplate 11 and the faceplate 12. However, the adapter plate 13 is disposed between the two to interrupt and alter this arrangement, as is described below.

Referring to FIGS. 3 and 4, the faceplate 12 is a rigid plate preferably constructed of metal or plastic. It includes a back 40 defined within a peripheral lip 41. The faceplate 12 includes a channel 42 extending continuously around the lip 41 and carrying a rubber seal or other type of gasket 43. The channel 42 closely holds the gasket 43. The channel 42 corresponds in shape and size to the channel 23 in the backplate 11. Several mounts 44 are formed about the faceplate 12 to correspond to the mounts 25 on the backplate 11; bolts 45 carried by the faceplate 12 extend through the mounts 44 and can be tightened into the mounts 25 of the backplate 11 to secure the backplate 11 with respect to the faceplate 12.

The faceplate 12 includes four tap ports 50 extending outwardly from the back 40, each of which is covered by a cap. These tap ports 50 provide the tapping functionality of the tap 10. In operation, coaxial cables are connected to these tap ports 50 to tap off the hard line connected to the ports 30 and 31, so that a signal may be transmitted to subscriber devices. Since there are four tap ports 50, the tap 10 shown in FIGS. 1-4 is capable of branching four lines off the hard line to run to four subscribers. It is noted that the disclosure applies equally to 2-, 3-, 6-, 8-, and N-way taps as one having ordinary skill in the art will understand, where N is an integer number.

The faceplate 12 also includes an inner face 51 shown in FIG. 3. Carried on the inner face 51 is a printed circuit board 52, with electrical circuitry that contacts and connects to each of the tap ports 50, coupling them in electrical communication to two sockets 53 and 54. The sockets 53 and 54 correspond to, are complemental to, and snugly receive the terminal posts 35 and 36, respectively. Without the adapter plate 13 disposed between the backplate 11 and the faceplate 12, the printed circuit board 52 directly affects the tapping of the hard line: the socket 53 in the faceplate 12 would be in contact and electrical communication with the terminal post 35, the socket 54 would be in contact and electrical communication with the terminal post 36, and the printed circuit board 52 connects the sockets 53 and 54 to the tap ports 50. As such, an RF signal would propagate from the input port 30 to the output port 31 and would also be directly tapped to each of the four tap ports 50. In this way, the tap 10 functions to continue the main signal while also creating four branched or tapped signals. Indeed, in FIGS. 1-4, two different signals are shown: the signal S transmitted through the input and output ports 30 and 31, and the tap signal T tapped from signal S and transmitted through the tap port 50. The signal S has a signal polarity, and the tap signal T has a tap signal polarity. It is noted that only one exemplary tap signal T from one of the tap ports 50 is shown but that there are four tap signals from the four tap ports 50.

The adapter plate 13 is inserted between the backplate 11 and the faceplate 12. The adapter plate 13 reverses or inverts the polarity of the signal S communicated to and from the input and output ports 30 and 31. The adapter plate 13 is thus especially useful in accommodating the polarity change created by a node split. The adapter plate 13 performs an upstream inversion or switch by electrically cross-coupling the backplate 11 and the faceplate 12, so that the printed circuit board 52 in the faceplate 12 receives a tap signal polarity in the tap signal T (exiting the adapter plate 13) which is inverted with respect to the signal polarity of the signal S, even through a "normal" signal polarity of the signal S enters the adapter plate 13. Of course, when the "normal" signal polarity has been inverted by the upstream node split, the inverted tap signal polarity in the tap signal T actually has the original and accurate polarity of the signal S when it left the headend. CATV devices on tapped lines downstream from the tap 10 thus receive a tap signal T with true polarity. This allows cable operators to leave existing hardware in place and install only the new adapter plate 13 between the backplate 11 and faceplate 12.

Referring now to FIGS. 3 and 4, the adapter plate 13 inverts the signal polarity of any downstream RF signal S from the input port 30 (or the input port 32) and of any upstream RF signal S from the output port 31 (or the output port 33, respectively). The adapter plate 13 is a rigid frame preferably constructed of metal or plastic. It includes a peripheral rim 60 with opposed front and rear sides 61 and 62. The rim 60 corresponds in shape and size to the lip 22 of the backplate 11 and to the lip 41 of the faceplate 12, such that when the backplate 11, faceplate 12, and adapter plate 13 are fit together, the lip 22, lip 41, and rim 60 are flush and contiguous with each other. Because the rim 60, lip 22, and lip 41 are contiguous and corresponding in shape and size to each other, the backplate 11, the faceplate 12, and the adapter plate 13 have an identical peripheral form factor; the size and outer contours of each is the same where each is adjacent. This confirms a proper fit in an assembled condition of the tap 10. The front side 61 of the rim 60 is formed with a peripheral channel 65 to receive and seat the gasket 24 in the backplate 11. Likewise, the rear side 62 of the rim 60 is also formed with a peripheral channel 66 to receive and seat the gasket 43 in the faceplate 12. The channels 65 and 66 correspond in shape and size to each other and to the channels 23 and 42 in the backplate 11 and the faceplate 12, respectively. Several bores or mounts 63 are formed about the adapter plate 13 to allow the bolts 45 in the faceplate 12 to pass through and secure in the mounts 25 of the backplate 11. When secured in the assembled condition of the tap 10, the gaskets 24 and 43 are compressed and form impermeable seals, rendering the tap 10 weatherproof.

The adapter plate 13 includes a midplane printed circuit board 64 extending across the top of the adapter plate 13 and fit between the front and rear sides 61 and 62. Two sockets 70 and 71 project from the printed circuit board 64 toward the front side 61, and two terminal posts 72 and 73 project from the printed circuit board 64 toward the rear side 62. With respect to the rim 60 and the lip 41, the sockets 70 and 71 correspond in location to the sockets 53 and 54 on the faceplate 12, so that when the adapter plate 13 is applied to the backplate 11, the sockets 70 and 71 correspond to, are complemental to, and snugly receive the terminal posts 35 and 36, respectively. Similarly, with respect to the rim 60 and the lip 22, the terminal posts 72 and 73 correspond in location to the terminal posts 35 and 36 on the backplate 11, so that when the adapter plate 13 is applied to the faceplate 12, the terminal posts 72 and 73 correspond to, are complemental to, and are snugly received in the sockets 53 and 54, respectively. As such, when the backplate 11, faceplate 12, and adapter plate 13 are in the assembled condition, the terminal post 35 is seated in the socket 70, the terminal post 36 is seated in the socket 71, the terminal post 72 is seated in the socket 53, and the terminal post 73 is seated in the socket 54, each seated connection establishing electrical continuity between the respective terminal post and socket pair. This cross-couples the backplate 11 and the faceplate 12; while without the adapter plate 13, the terminal posts 35 and 36 would be electrically coupled with the same-side sockets 53 and 54, the adapter plate 13 electrically couples the terminal posts 35 and 36 with the opposite side sockets 54 and 53, respectively. This is what effects the polarity inversion between the signal S and the tap signal T.

The adapter plate 13 includes an electrical circuit 74 which inverts the polarity of the tap signal T with respect to that of the signal S. As can be seen when viewing both FIG. 3 and FIG. 4, the circuit 74 from the socket 70 connects to the terminal post 73, and the circuit 74 from the socket 71 connects to the terminal post 72. This inverts the polarity of the signal S before reaching the faceplate 12 without altering the polarity of the backplate 11. In other words, this structure effectively inverts the polarity of the faceplate 12, and the tap ports 50 thereon, with respect to the backplate 11 and the ports 30-33 thereon. For example, the polarity of the downstream RF signal S from the input port 30 to the output port 31 is inverted, by the adapter plate 13, when it reaches the sockets 53 and 54.

After the faceplate 12 is secured to the adapter plate 13, the polarity of the signal transmitted to or from the subscribers is no longer reversed with respect to its original polarity at either the headend or the subscriber, so that the tap 10 operates with correct polarity. For example, when the signal S is carried along the hard line and to the input port 30 downstream from a node split, the signal polarity is first reversed at the node split. The adapter plate 13 then inverts the signal polarity of the "reversed" signal S again, thereby providing a correct and accurate signal polarity to the printed circuit board 52 on the faceplate 12. By installing the adapter plate 13, the reversed directionality of the incoming signal S is returned to its original headend polarity, and the tap signal T carried to or from the subscribers maintains its original or headend polarity. As such, CATV devices downstream from the tap 10 operate with correct—and corrected—polarity.

A preferred embodiment is fully and clearly described above so as to enable one having skill in the art to understand, make, and use the same. Those skilled in the art will recognize that modifications may be made to the description above without departing from the spirit of the invention, and that some embodiments include only those elements and features described, or a subset thereof. To the extent that modifications do not depart from the spirit of the invention, they are intended to be included within the scope thereof.

The invention claimed is:

1. A telecommunication tap comprising:

a backplate having an input port, an output port, and terminal posts, wherein the input and output ports communicate a signal having a signal polarity;

a faceplate having a tap port and having sockets corresponding and complemental to the terminal posts, wherein the tap port communicates a tap signal having a tap signal polarity; and an adapter plate disposed between the backplate and faceplate, the adapter plate having an electrical circuit which inverts the tap signal polarity with respect to the signal polarity.

2. The telecommunication tap of claim 1, wherein:

the adapter plate has sockets corresponding and complemental to the terminal posts on the backplate; and the adapter plate has terminal posts corresponding and complemental to the sockets on the faceplate.

3. The telecommunication tap of claim 2, wherein:

the terminal posts on the backplate and the adapter plate correspond in location to each other; and the sockets on the adapter plate and the faceplate correspond in location to each other.

4. The telecommunication tap of claim 1, wherein the backplate, faceplate, and adapter plate all have an identical peripheral form factor.

5. The telecommunication tap of claim 1, further comprising:

the backplate has a channel for holding a gasket, the faceplate has a channel for holding a gasket, and the adapter plate has channels on opposed sides of the adapter plate for holding gaskets; and the channels all correspond in shape and size to each other.

6. A telecommunication tap comprising:

a backplate having an input port and an output port, wherein the input and output port communicate a signal having a signal polarity;

a faceplate having a tap port which communicates a tap signal having a tap signal polarity; and an adapter plate disposed between the backplate and faceplate, the adapter plate having an electrical circuit which inverts the tap signal polarity with respect to the signal polarity.

7. The telecommunication tap of claim 6, further comprising:

the backplate has terminal posts; and the faceplate has sockets corresponding and complemental to the terminal posts.

8. The telecommunication tap of claim 7, wherein:

the adapter plate has sockets corresponding and complemental to the terminal posts on the backplate; and the adapter plate has terminal posts corresponding and complemental to the sockets on the faceplate.

9. The telecommunication tap of claim 8, wherein:

the terminal posts on the backplate and the adapter plate correspond in location to each other; and the sockets on the adapter plate and the faceplate correspond in location to each other.

10. The telecommunication tap of claim 6, wherein the backplate, faceplate, and adapter plate all have an identical peripheral form factor.

11. The telecommunication tap of claim 6, further comprising:

the backplate has a channel for holding a gasket, the faceplate has a channel for holding a gasket, and the adapter plate has channels on opposed sides of the adapter plate for holding gaskets; and the channels all correspond in shape and size to each other.

12. A telecommunication tap comprising:

a backplate having an input port and an output port for transmitting a signal therebetween, the signal having a signal polarity;

a faceplate having a tap port which communicates a tap signal having a tap signal polarity; and an adapter plate disposed in electrical contact between the backplate and the faceplate, the adapter plate communicating the signal and the tap signal between the backplate and the faceplate and inverting the tap signal polarity with respect to the signal polarity.

13. The telecommunication tap of claim 12, further comprising:

the backplate has terminal posts; and the faceplate has sockets corresponding and complemental to the terminal posts.

14. The telecommunication tap of claim 13, wherein:

the adapter plate has sockets corresponding and complemental to the terminal posts on the backplate; and the adapter plate has terminal posts corresponding and complemental to the sockets on the faceplate.

15. The telecommunication tap of claim 14, wherein:

the terminal posts on the backplate and the adapter plate correspond in location to each other; and the sockets on the adapter plate and the faceplate correspond in location to each other.

16. The telecommunication tap of claim 12, wherein the backplate, faceplate, and adapter plate all have an identical peripheral form factor.

17. The telecommunication tap of claim 12, further comprising:

the backplate has a channel for holding a gasket, the faceplate has a channel for holding a gasket, and the adapter plate has channels on opposed sides of the adapter plate for holding gaskets; and the channels all correspond in shape and size to each other.

* * * * *